US005676452A

United States Patent [19]

Scholz

[11] Patent Number: 5,676,452

[45] Date of Patent: Oct. 14, 1997

[54] OPERATING LAMP WITH MAIN BULB AND REPLACEMENT BULB

[75] Inventor: Manfred Scholz, Seitingen, Germany

[73] Assignee: Gebr. Berchtold GmbH & Co., Tuttlingen, Germany

[21] Appl. No.: 608,240

[22] Filed: Feb. 28, 1996

[30] Foreign Application Priority Data

Mar. 2, 1995 [DE] Germany ..... 195 07 305.3

[51] Int. Cl.[6] ..... F21V 19/04

[52] U.S. Cl. ..... 362/254; 362/20; 362/276; 362/287; 362/427

[58] Field of Search ..... 362/254, 20, 276, 362/802, 287, 418, 427; 315/88; 340/641, 642, 930, 931

[56] References Cited

U.S. PATENT DOCUMENTS

| | | | |
|---|---|---|---|
| Re. 31,987 | 9/1985 | Hartung et al. | 362/20 |
| 2,551,029 | 5/1951 | MacKay | 362/20 |
| 5,023,515 | 6/1991 | Olon et al. | 362/20 |
| 5,032,962 | 7/1991 | Gehly et al. | 362/20 |

FOREIGN PATENT DOCUMENTS

| | | |
|---|---|---|
| 3920494 | 1/1991 | Germany . |

*Primary Examiner*—Carl D. Price
*Assistant Examiner*—Sara Sachie Raab
*Attorney, Agent, or Firm*—Townsend and Townsend and Crew LLP

[57] ABSTRACT

An operating lamp has at least one main bulb 11 arranged at a desired position 13 and a replacement bulb 12 arranged at a waiting position 14 located close the desired position 13. The main bulb 11 and the replacement bulb 12 are displaceably mounted and controlled in such a way that when the main bulb 11 burns out it is moved away from the desired position 13 and the replacement bulb 12 is moved from the waiting position 14 to the desired position 13 and is held there. The main bulb 11 and the replacement bulb 12 are mounted on holders 15, 16 which are moveable independently of one another.

18 Claims, 7 Drawing Sheets

OPERATING LAMP WITH MAIN BULB AND REPLACEMENT BULB

BACKGROUND OF THE INVENTION

The invention relates to an operating lamp with at least one main bulb placed at a desired position and a replacement bulb placed at a waiting position located close to the desired position, with the main bulb and the replacement bulb being displaceably mounted and controlled in such a way that when the main bulb burns out it is moved away from the desired position and the replacement bulb is moved from the waiting position to the desired position and is held there. The invention also relates to a method for replacing the main bulb and the replacement bulb in such an operating lamp Such operating lamps are known in various embodiments (U.S. Pat. No. 5,023,515, DE-U-93 11 156 and 93 19 274; DE-OS 39 20 494). In these arrangements the two bulbs are displaced via complicated parallel guides (U.S. Pat. No. 5,023,515), via rotating platforms (DE-OS 39 20 494) or by means of a rocker (DE-GBM 93 11 156) when the main bulb burns out and is to be replaced by a replacement bulb. The latter solutions are complicated and take up a relatively large amount of space. Furthermore, the replacement bulb is located at least partially in the beam path of the main bulb and thus blocks off a part of the light emitted from it.

An arrangement is also known in which the main bulb and the replacement bulb are mounted at fixed locations, which are both located somewhat away from the focal point. When the main bulb burns out, an automatic switchover to the replacement bulb is performed without any mechanical movement of the bulb sockets. A disadvantage of this arrangement is that the light yield is not ideal as a result of the intentional defocusing.

SUMMARY OF THE INVENTION

The object of the present invention is thus to provide a further operating lamp of the initially named type. In particular a simple, safe and economical positioning apparatus is to be provided in which as little light from the main bulb as possible is blocked off by the replacement bulb.

The idea of the invention is thus that on replacement the two bulbs are not moved simultaneously, but at successive times, and are mounted on pivoted or displaced bodies which are movable independently of one another. In this way it is possible e.g. to remove the burned out and thus worthless main bulb away from the focal point (desired position) rapidly and without regard to shock or vibration etc. and then to move the replacement bulb cautiously and gently to the desired position.

A constructionally especially advantageous embodiment is characterised in that two pivotal holders are constructionally simple and can be installed compactly. Especially advantageous here is the use of rotatable sleeves arranged behind one another for the pivotal holders.

Whereas the rotatable sleeves of claim 4 can theoretically be separately driven by motors, the use of a single motor in is nevertheless preferred. As a result of this embodiment, the carrying arm of the main bulb can be quickly moved away from the desired position by the spring tension and by the action of the motor, which is likewise under the influence of the spring. Since the same motor subsequently conveys the replacement bulb to the desired position against the action of a further spring, i.e. since the motor must now act against a spring tension, the movement of the replacement bulb to the desired position takes place cautiously and without shock, without the provision of any reswitching being necessary, so that damage to the replacement bulb is effectively avoided during the change of bulbs.

The same type of pivotal holder can be used for the main bulb as well as for the replacement bulb in spite of the arrangement of the rotatable sleeves behind one another.

If in accordance with the invention only a single motor is used for driving both the pivotal holders, it is advantageous to provide for two directions of rotation, which can however also be realised by a change-over gearbox.

The switching on of the replacement bulb or of the main bulb respectively and of the motor is advantageously accomplished.

BRIEF DESCRIPTION OF THE DRAWING

Examples of the invention will be explained in the following with regard to the drawings. Shown are.

DESCRIPTION OF THE PREFERRED EMBODIMENT

Figure 1:
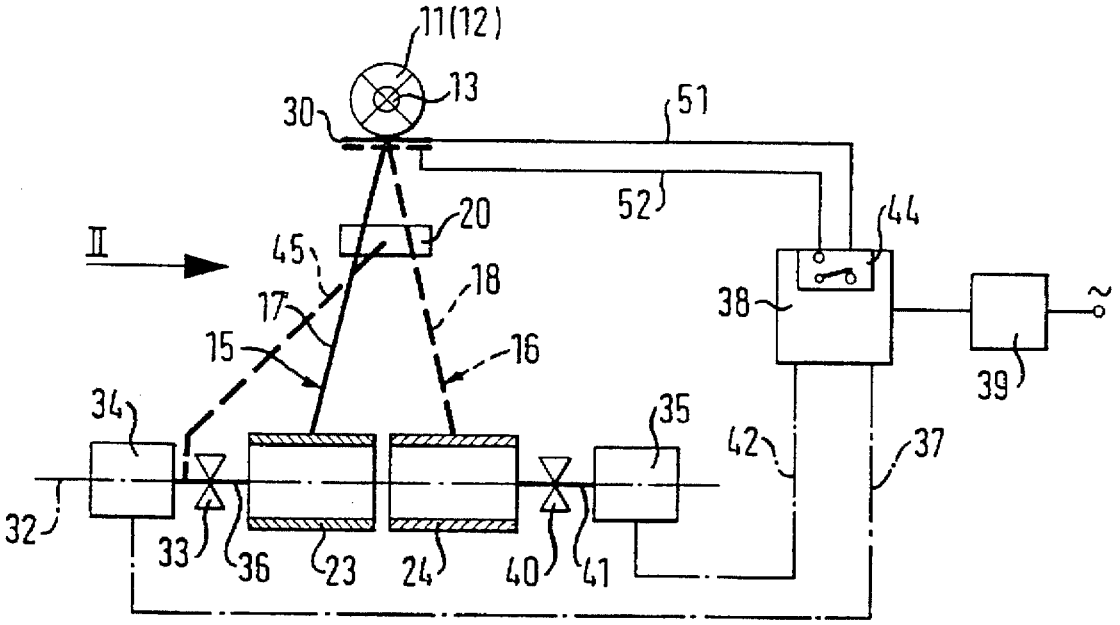
FIG. 1 a schematic view of the bulb holder of an operating lamp in accordance with the invention substantially in the direction of movement of the main bulb after it has burned out, FIG. 2 a schematic view of the subject of FIG. 1 in the direction of the arrow II in FIG. 1, FIG. 3 a view of a practical embodiment analogous to FIG. 1, FIG. 4 a schematic view of the subject of FIG. 3 in the direction of the arrow IV in FIG. 3, FIG. 5 a schematic plan view of the subject of FIG. 4 when the bulbs are removed from the sockets, FIG. 6 a view similar to FIG. 5 with an especially advantageous bulb arrangement, FIG. 7 a schematic view analogous to FIG. 1 of a further embodiment with identical pivotal holders but displaced with respect to one another by 180°, FIG. 8 a partial view of a further advantageous embodiment of the pivotal holders analogous to FIG. 3, FIG. 9 a schematic sectional view along line IX—IX in FIG. 8 not true to scale and FIG. 10 a preferred circuit for the power supply to the bulbs and the drive motor.
Figure 2:
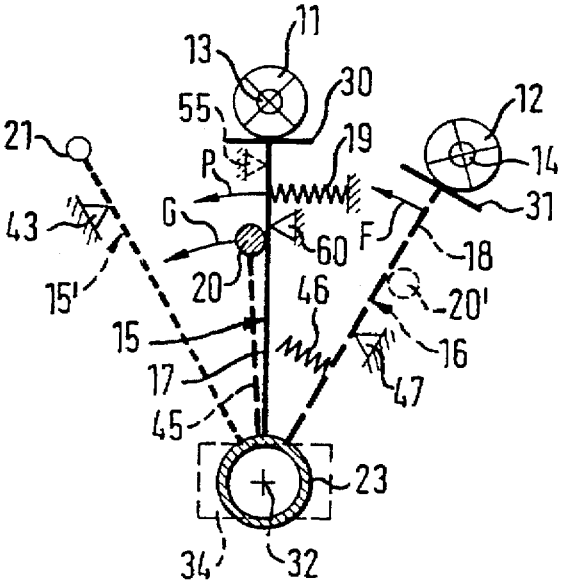

In accordance with FIGS. 1 and 2 a main bulb 11 of an operating lamp, which is not shown in detail, is mounted via a socket 30 on a pivotal holder 15 which has a carrying arm 17 which extends from the socket 30 to a rotatable sleeve 23 which is rotatably mounted via an only schematically illustrated bearing 33 about an axis of rotation 32. The rotatable sleeve 23 is connected drive-wise via a drive train 36, which can also contain a reduction gearing, to an electric motor 34, which is connected to a central control device 38 via a control and drive line 37. The control device 38 contains a change-over switch 44 which is connected to the main bulb 11 and the replacement bulb 12 via supply lines 51, 52 respectively. Normally the change-over switch 44 is in such a position that it supplies only the main bulb 11 with current via the supply line 51. If the main bulb 11 burns out, the control device 38 automatically switches the change-over switch 44 to its other position, in which it supplies the replacement bulb 12 with current via the supply line 52. A preferred realisation of the change-over switch 44 will be described below with reference to FIG. 10. The control device 38 is supplied with the required voltage and power via a power supply 39 connected to the mains.

In axial alignment with the rotatable sleeve 23 and axially displaced therefrom there is provided a further rotatable sleeve 24 which is coaxial to the rotatable sleeve 23 and independent of the latter, the further rotatable sleeve 24 belonging to a further pivotal holder 16 for a replacement bulb 12. A carrying arm 18, indicated by a dashed line, extends from the rotatable sleeve 24 to the socket 31 of a replacement bulb 12, indicated by a dashed line, lying on the same circular track as the main bulb 11 relative to the axis of rotation 32. The rotatable sleeve 24 is rotatably mounted by means of a merely schematically represented bearing 40 and is connected via a drive train 41, which can also contain reduction gearing, to an electric motor 35, which is connected to the control device 38 via a control and drive line 42 in order to receive the required control and drive signals from said control device 38 when the main bulb 11 burns out.

The operating lamp described works in the following manner: When the main bulb 11 burns out, the switch 44 automatically switches on the replacement bulb 12. At the same time the control device 38 sets the electric motor 34 in motion via the control and drive line 37. The electric motor then sets the pivotal holder 15 of the main bulb in rotation in the direction of the arrow P in FIG. 2 until it has reached the position 15' shown in dotted lines in FIG. 2. As a result, the main bulb 11 is moved from the desired position 13 located at the focus of the operating lamp into the bulb replacement position 21.

An abutment 43 for instance is located there at which the holder 15 comes to rest. At this moment, or at a somewhat later time, the electric motor 34 is switched off by the control device 38, which can take place either by a timing circuit provided in the control device 38 or by an end switch provided in the region of the abutment 43.

The control device 38 then switches on the electric motor 35 via the control and drive line 42, said electric motor 35 now setting the replacement bulb holder 16 in rotation in the direction of the arrow F in FIG. 2, whereby the replacement bulb 12 is pivoted from its waiting position 14 to the desired position 13. There the control device 38 stops the electric motor 35, either as a result of a suitable timer circuit provided internally or as a result of a switch contact provided in the region of the desired position 13, with the replacement bulb 12 now being positioned at the desired position 13 and assuming the function of the main bulb 11.

After replacement of the main bulb 11 in the bulb replacement position 21 with the lamp being turned off after an operation has been concluded, for example the return of the main bulb 11 to the desired position 13 proceeds as follows:

When the operating lamp is switched on, the control device 38 automatically switches off the replacement bulb 12 or leaves it switched off respectively as a result of the resumed current flow to the main bulb 11. At the same time the motors 34, 35 are driven successively in such a manner that the replacement bulb 12 is first pivoted back from the desired position 13 to the waiting position 14, whereupon the main bulb 11 is then pivoted from the bulb replacement position 21 to the desired position 13. Now the operating lamp is again in a fully operational condition; i.e. when the main bulb 11 burns out again, the replacement bulb 12 is again pivoted to its position, as has been described above.

In FIGS. 1 and 2 a further possibility for driving the bulb holders 15, 16 is also indicated.

In accordance with FIG. 2 the main bulb holder 15 can be pressed by means of a merely schematically indicated spring 19 in the direction of the arrow P against an abutment 20, which is connected to the rotary shaft of the electric motor 34 via an actuation arm 45 which is indicated by a dashed line.

The rotatable sleeves 23, 24 are freely rotatably arranged on a suitable stationary and non rotatable shaft in this case (i.e. they are not directly driven by the electric motors 34, 35).

The fixation of the main bulb 11 at the desired position 13 and the replacement bulb 12 at the waiting position 14 is effected by the carrying arm 17 being pressed by means of the spring 19 against the abutment 20 and by the carrying arm 18 being pressed by means of a spring 46 against an abutment 47 secured to the housing respectively.

When now, after the main bulb 11 has burned out, the control device 38 switches on the replacement bulb 12 and sets the electric motor 34 rotating, the abutment 20 moves in the direction of the arrow G in FIG. 2, whereupon the spring 19 sets the holder 15 in motion in the direction of the arrow P until it lies in contact with the abutment 43 and the main bulb 11 has reached the bulb replacement position 21. In this position the holder 15 is fixed by the spring 19 and the abutment 43.

The abutment 20 however continues moving along a circular path about the axis of rotation 32 until it reaches the position designated by 20' in FIG. 2 and now acts on the carrying arm 18 in FIG. 2 from the right. Thereupon the pivotal holder 16 of the replacement bulb is set in motion in the direction of the arrow F with the bulb already lighted, compressing the spring 46 until the replacement bulb 12 has reached the desired position 13, where it is stopped e.g. by an abutment 55 secured to the housing and acting only on the carrying arm 18. At this moment, or shortly thereafter, the control device 38 switches off the electric motor 34 as a result of a built-in timer circuit or of a position switch, whereupon the abutment 20 comes to rest and the replacement bulb 12 is now fixed at the desired position 13.

The return guidance of the pivotal holders 15, 16 after replacement of the burned out main bulb 11 by a new one proceeds in the reverse direction; i.e. by reversing the direction of the motor 34, the replacement bulb 12 is first pivoted from the desired position 13 back to the waiting position 14 and then the main bulb 11 is pivoted by means of the abutment 20 from the bulb replacement position 21 to the desired position 13. An abutment 30 fixed to the housing and acting only on the carrying arm 17 limits the reverse movement of the carrying arm 17 and fixes the main bulb 11 at the desired position 13.

In the following, the same reference numerals designate components corresponding to those in the preceding description.

In the following, practical exemplary embodiments of the two designs already described and shown in FIGS. 1, 2 will be described with regard to FIGS. 3 to 5.

Figure 5:
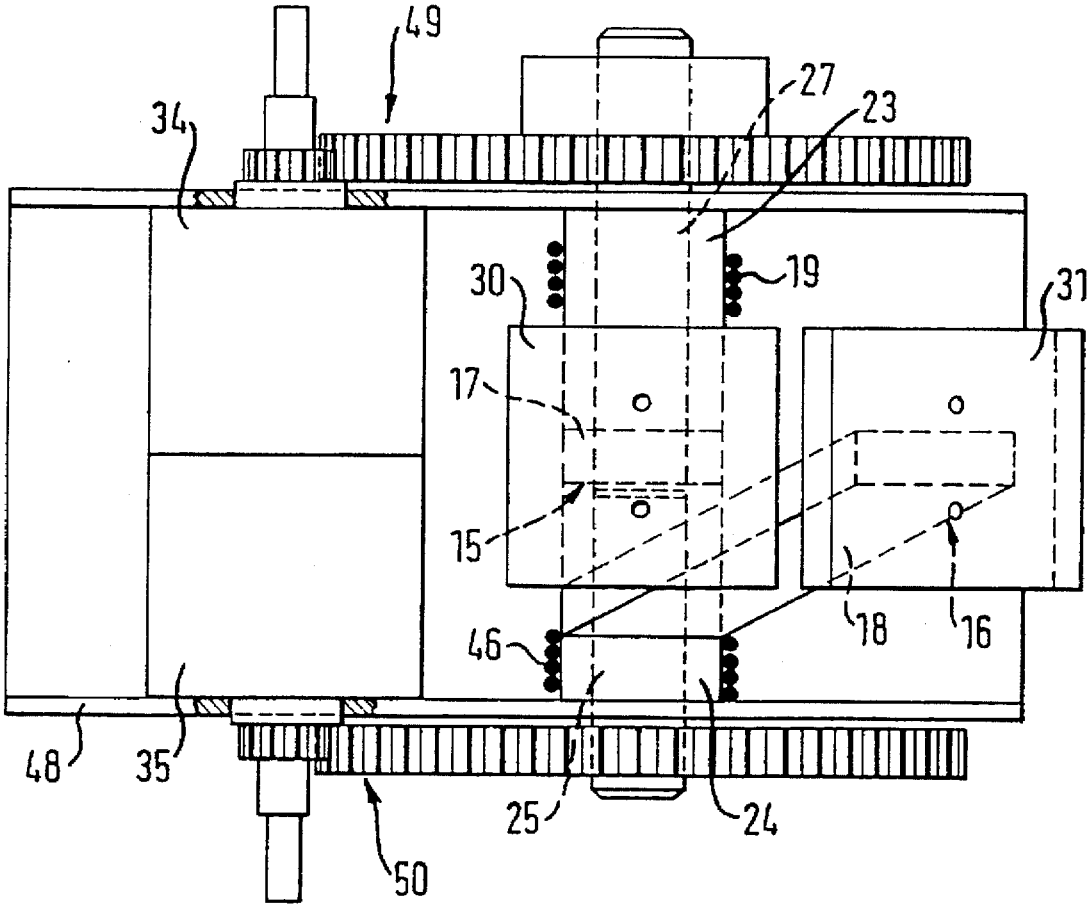

In accordance with FIG. 5 the two electric motors 34, 35 are placed behind one another in a housing 48 and drive the rotatable sleeves 23 and 24 respectively via suitable gear transmissions 49 and 50 respectively.

Figure 3:
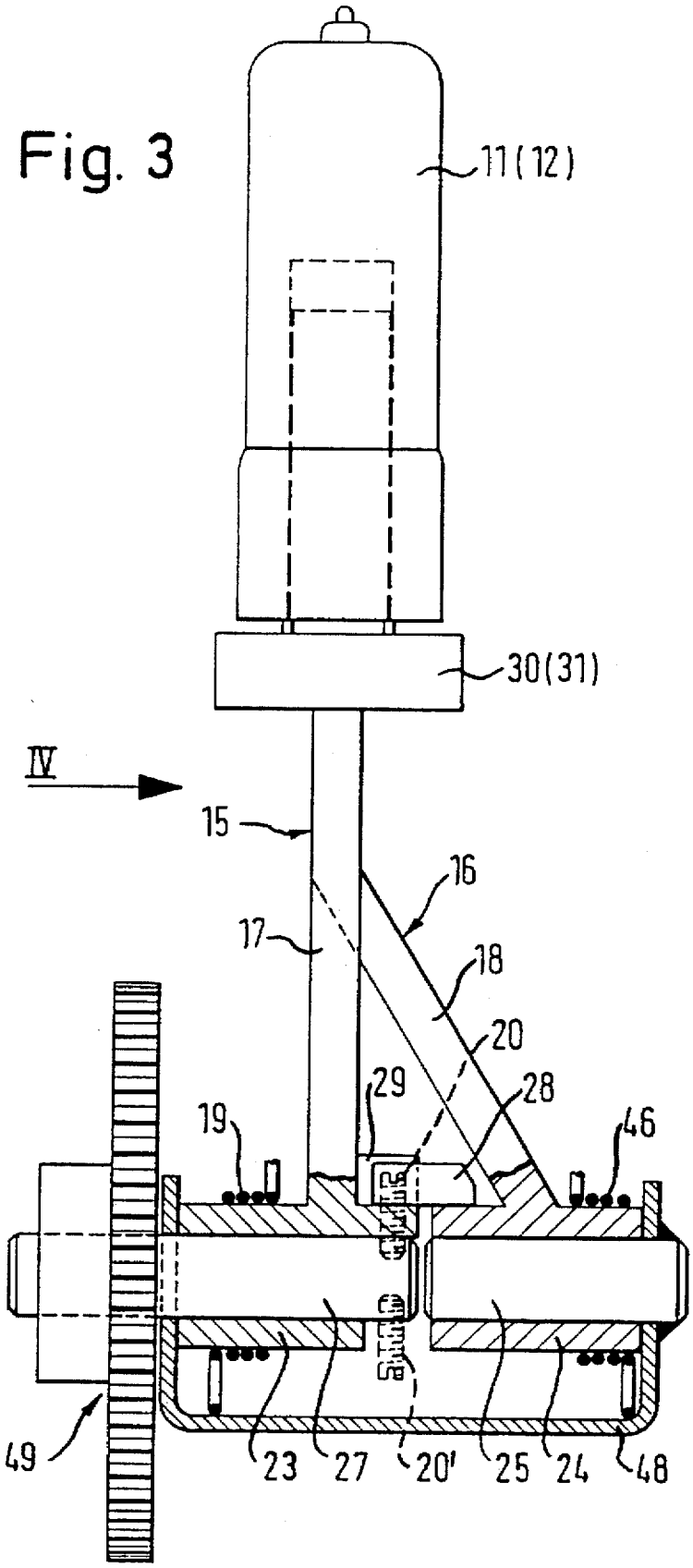

In the execution of the second embodiment described in regard to FIGS. 1 and 2, the electric motor 35 and the transmission 50 are absent in accordance with FIG. 3, and the drive shaft 27 of the transmission 49 extends into the interior of the rotatable sleeve 23 through a bearing fixed to the frame. From the opposite side of the frame 48 a stationary rotary bearing spigot 25 secured to the housing 38 extends coaxial to the rotatable shaft 27 into the interior of the further rotatable sleeve 24.

Figure 4:
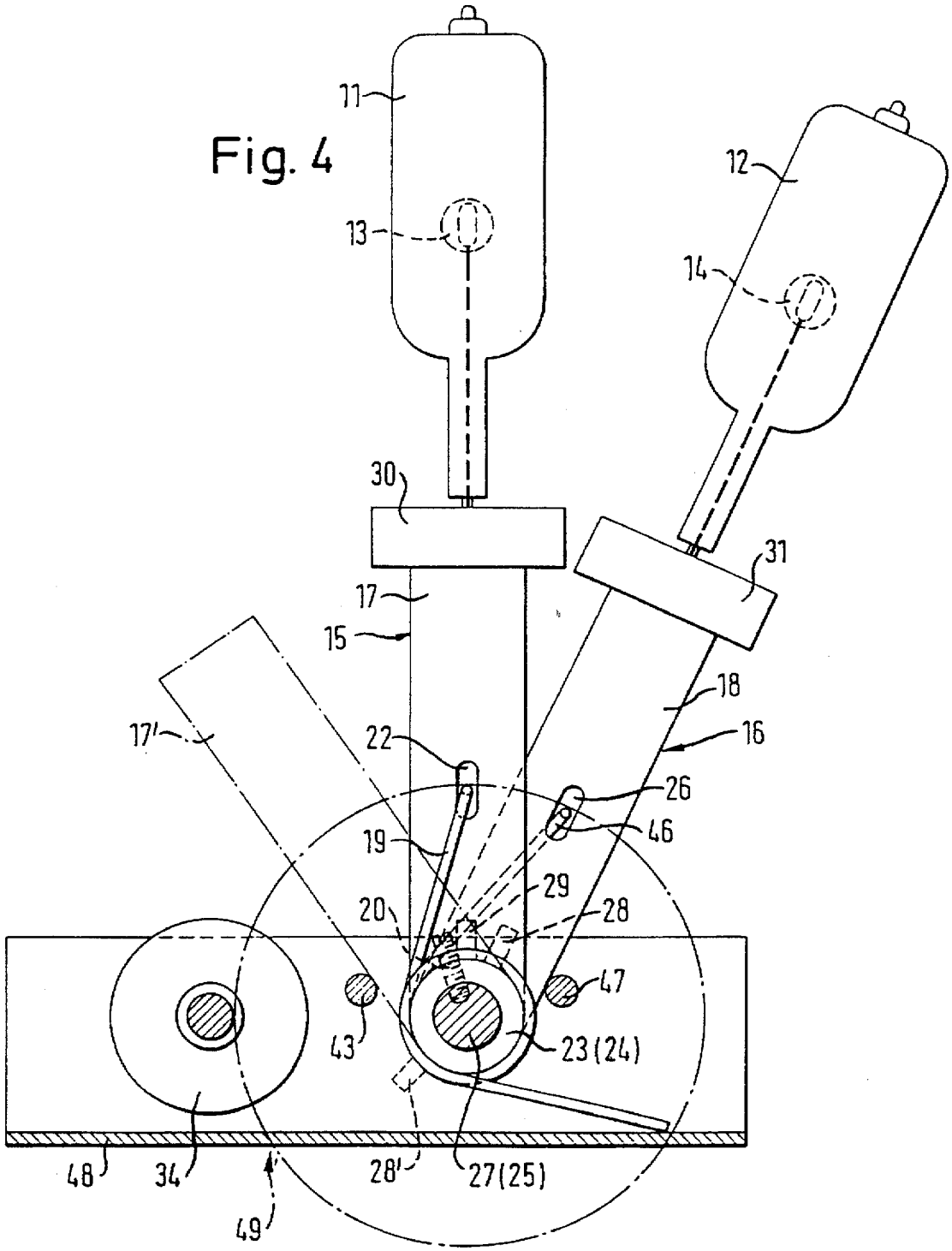

In accordance with FIGS. 3 and 4, a radial abutment 20 is secured to the end of the rotatable shaft 27 near the spigot 25 and extends radially beyond the outer periphery of the rotatable shaft 27 and co-operates with a counter abutment 29 secured to the rotatable sleeve 23.

In FIG. 3, for the sake of illustration, the abutment is shown once in an ineffective position 20' and once at 20 in contact with the counter abutment 29 which is provided at the perimeter of the rotatable sleeve 23. Furthermore, one can see from FIGS. 3 and 4 a counter abutment 28 which is provided at the rotatable sleeve 24 and which likewise extends axially into the path of the abutment 20.

The rotatable sleeve 24 ends before the abutment 20 in the direction of the stationary spigot 25 so that it can move freely during the rotation of the rotatable shaft 27 except for the intentional restraint by the counter abutments 28, 29.

The springs 19, 46 are executed in accordance with FIG. 4 as coil springs which are braced at one end against the housing 48 and engage at the other end in elongated holes 22, 26 of the carrying arms 17 and 18 respectively.

The function of the practical exemplary embodiment with only one electric motor 34 in accordance with FIGS. 3, 4 is analogous to that of the second exemplary embodiment described with reference to FIGS. 1 and 2.

The basic position of the positioning apparatus in accordance with the invention is shown in FIG. 4. When the electric motor 34 is switched on, the abutment 20 in FIG. 4 moves counterclockwise, whereby the coiled spring 19 can likewise set the carrying arm 17 in counterclockwise rotation until it strikes against the abutment 43 and comes to rest in the position 17' shown in chain dotted lines. This is the bulb replacement position (21 in FIG. 2).

Then the abutment 20 continues rotating counterclockwise until it comes into contact with the counter abutment 28 of the rotatable sleeve 24 and lifts the rotatable sleeve 24 and the carrying arm 18 away from the abutment 47 against the force of the coil spring 46. It now pivots the carrying arm 18 as well as the replacement bulb 12 into the position which had previously been occupied by the carrying arm 17 and the main bulb 11, i.e. brings them into the desired position 13.

The counter abutment of the rotatable sleeve 24 is preferably located at 28' in FIG. 4 because then the abutment 20 runs up against the counter abutment 28' immediately after the carrying arm 17 has come into contact with the abutment 43, so that the pivotal holder 16 carrying the replacement bulb 12 begins moving, immediately after the pivotal holder 15 comes to rest, towards the position in which the replacement bulb 12 is located at the desired position 13.

Figure 6:
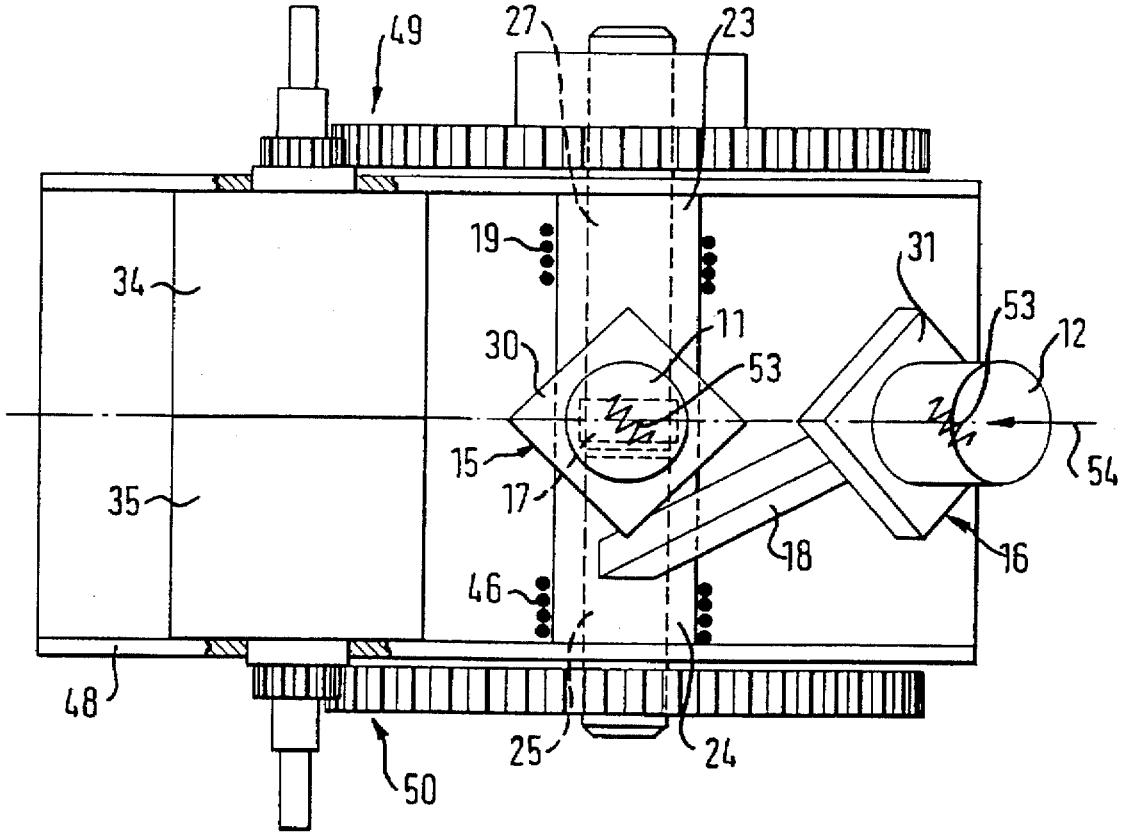

In the exemplary embodiment of FIG. 6 the sockets 30, 31 are rotated with respect to the arrangement of FIG. 5 by 45° about the longitudinal axis of the carrying arms 17 and 18 respectively in such a manner that the filaments 53 of the main bulb 11 and the replacement bulb 12 indicated in FIG. 6, although still parallel to one another, are arranged laterally displaced with respect to one another in such a manner that the light beams emitted from the filaments 53 are not occluded by the other respective bulb.

The execution of the pivotal holders 15, 16 in this case must be such that the centres of the filaments 53 of both bulbs 11, 12 lie behind one another in the peripheral direction 54 determined by the pivotal motion so that the filaments 53 of both bulbs 11, 12 take on exactly the same position when placed at the desired position 13.

Figure 7:
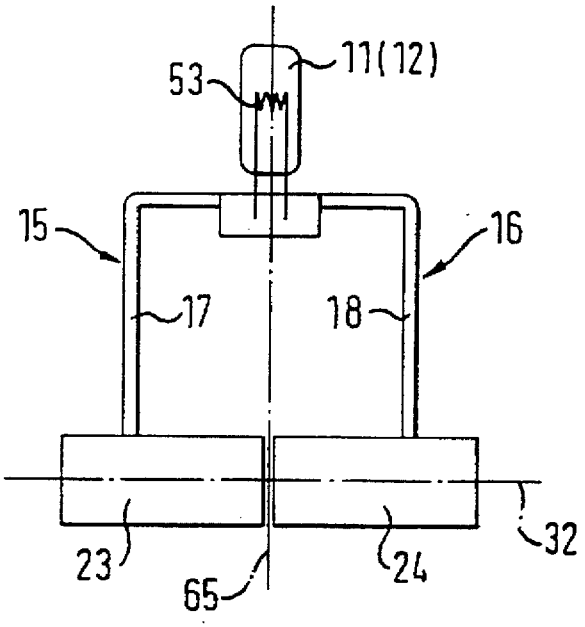

FIG. 7 schematically shows an especially preferred embodiment in which two pivotal holders 15, 16 of identical construction are provided. Since the two pivotal holders 15, 16 are made to be symmetrical to that pivotal plane 60 which passes through the centres of the filaments 53, identically constructed pivotal holders 15, 16 can simply be placed behind one another on the axis of rotation 32 by rotating one through 180° with respect to the pivotal plane 60, whereupon the filaments 53 both of the main bulb 11 and of the replacement bulb 12 lie precisely in the pivotal plane 60. Thus, although the two rotatable sleeves 24 lie behind one another on the axis of rotation 82, it is still possible for both filaments 53 to be located in the pivotal plane 60 due to their being placed with a relative displacement of 180° with respect to one another. This embodiment is especially economical since only one type of pivotal holder need be manufactured and nevertheless the rotatable sleeves 23, 24 can be placed behind one another on the same axis of rotation (32), which is important for the possibility of having a drive with only a single motor.

Figure 8:
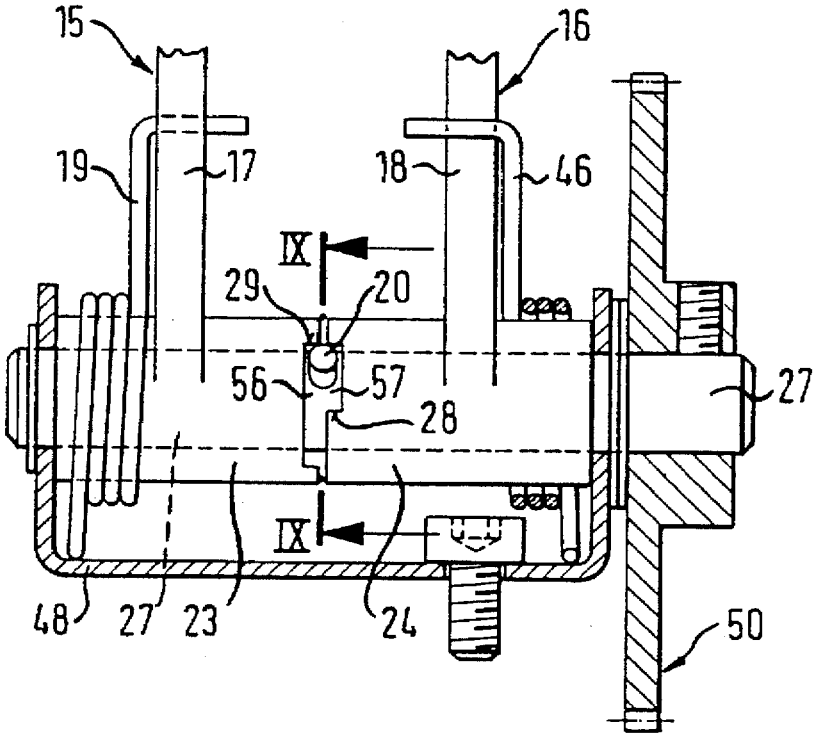

FIG. 8 shows a constructional execution of the embodiment described in reference to FIG. 7. Its special feature with respect to the preceding exemplary embodiments is that the rotatable shaft 27 extends through the two rotatable sleeves 23, 24 and is rotatably mounted at both ends in the frame 48. In this manner, no stationary rotary bearing spigot need be used for one of the rotatable sleeves, as is provided for the rotatable sleeve 24 in the exemplary embodiment of FIG. 3.

The rotatable shaft 27 passing through both rotatable sleeves 23, 24 thus represents a constructional simplification and further enables an especially compact and economical to manufacture arrangement of the abutment 20 and of the counter abutments 28, 29. This will be described in the following in relation to FIG. 9, which schematically illustrates the interplay of the abutment 20 with the counter abutments 28, 29.

The radially projecting abutment 20 having the form of a pin is again provided somewhere near the middle of the rotatable shaft 27 extending through the two rotatable sleeves 23, 24. To accommodate it the rotatable sleeves 23, 24 have sector shaped cut-outs 55, 56 at their ends bordering on one another, which cut-outs can however have differing extents in the peripheral direction corresponding to their function. For the purpose of illustration, the rotatable sleeve 23 is drawn in solid lines and the axially displaced rotatable sleeve 24 in dashed lines in FIG. 9. The rotatable shaft 27 extending through both rotatable sleeves 23, 24 is likewise drawn in solid lines.

Figure 9:
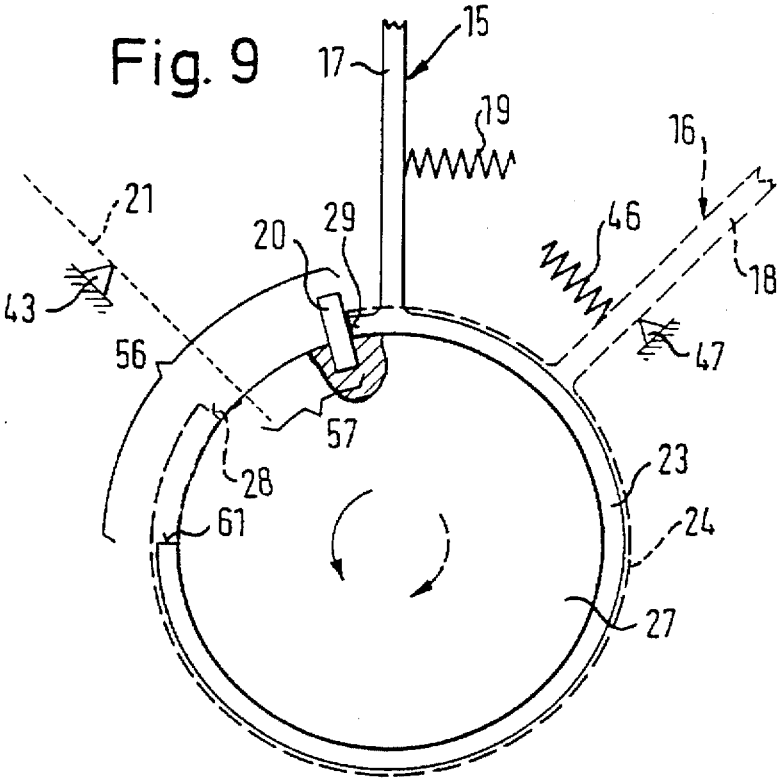

In the normal situation of the pivotal holders 15, 16, the rotatable shaft 27 is in the position shown in FIGS. 8 and 9, in which the radial abutment 20 in FIG. 9 is displaced counterclockwise slightly to the left with respect to the vertical. The sector shaped cut-out 56 is now arranged in such a manner that its upper end in FIG. 8 forming the counter abutment 29, which is its right end in FIG. 9, is pressed against the abutment 20 by the spring 19 when the pivotal holder 15 is in the desired position.

In order that the motor 34 not be set in motion hereby, it or its transmission must be executed to be self inhibitory. This is generally done by using a geared motor with a transmission ratio of e.g. 1:140. It is advantageous to arrange the motor horizontally in such a manner that even at rest the gear teeth always dip into the oil bath present in the transmission along a part of their periphery. When the motor is then switched on, all regions of each gear of the transmission are already supplied with oil after the first full turn. Such an arrangement is significant for the present operating lamp because the main bulb 11 of an operating lamp relatively seldom burns out and the geared motor is thus put into operation relatively infrequently. On the other hand, the motor is strongly heated by the glowing bulb 11 or 12 so that the transmission oil collects in the lower region.

If now the main bulb 11 burns out, the motor 34 is switched on so that it begins to drive the rotatable shaft 27 in the direction of the arrow in FIG. 9 via the transmission 50. Then the abutment 20 in FIG. 9 freely moves counterclockwise within the sector shaped cut-out 57 of the rotatable sleeve 24, which at first is held fixed in its waiting position by the spring 46. However, the spring 19 maintains the contact of the counter abutment 29 with the abutment 20 by pivoting the pivotal holder 15 in FIG. 9 counterclockwise. In this manner the counter abutment 29 at first remains in contact with the abutment 20. In other words, the pivotal holder 15 follows the movement of the abutment 20 as a result of the action of the spring 19.

This sequence of movements continues until the pivotal holder 15 has reached the bulb replacement position 21 and the carrying arm 17 strikes up against the abutment 43. The spring 19 now presses the carrying arm 17 against the abutment 43 and the counter abutment 29 can no longer follow the further rotational movement of the abutment 20.

The rotatable shaft 27 however continues rotating in the direction of the arrow (FIG. 9) shown in solid lines. Now the sector shaped cut-out 57 of the rotatable sleeve 24 is dimensioned in the peripheral direction in such a manner that, in the view shown in FIG. 9, it terminates in the counterclockwise direction immediately behind the bulb replacement position 21 so that the abutment 20 finally strikes up against the counter abutment 28 of the rotatable sleeve 24 formed by the left end of the sector shaped cut-out 57 and now sets this rotatable sleeve 24 rotating against the force exerted by the spring 46. In order that the abutment 20 not come into contact with the counterclockwise end 61 of the sector shaped cut-out 56 present in FIG. 9 on continuation of the rotational movement, the sector shaped cut-out 56 must be executed to be correspondingly long in the peripheral direction. The rotational movement of the abutment 20 in contact with the counter abutment 28 now continues until the pivotal holder 16 comes into the desired position, which had first been occupied by the pivotal holder 15 (FIG. 8, 9). This position can be made definite for the pivotal holder 16 by a suitable abutment (55 in FIG. 2). Stopping the geared motor 34 is done either by an end switch connected to the abutment or preferably by a timer which allows the motor to run somewhat longer than necessary for reaching the abutment 55 defining the desired position. The drive power supplied to the geared motor 34 must be so small in this case that the motor is not damaged when the pivotal holder 16 strikes up against the abutment 55 in spite of the drive power which still continues to be supplied for a short time.

After the main bulb 11 has been replaced in the bulb replacement position 21, the rotatable shaft 27 is set rotating in the direction indicated by an arrow shown in dashed lines in FIG. 9, with the pivotal holder 16 first being moved clockwise by the spring 46 until it again lies in contact with the abutment 47. Then the abutment 20 engages the pivotal holder 15 by coming into contact with the counter abutment 29. The rotatable shaft 27 now pivots the pivotal holder 15 away from the bulb replacement position 21 against the spring 19 into the desired position seen in FIG. 9 where the pivotal holder 15 is again brought to a standstill by a suitable abutment (60 in FIG. 2) provided with an end switch if required. Here as well, the geared motor 34 can be switched by a timer in such a manner that it continues to be supplied with power for a short time after the pivotal holder 15 encounters the said abutment 55 and is only then switched off.

Thus in a constructionally very compact and simple to manufacture arrangement both the outward rotation and the return rotation of the main and replacement bulbs respectively can be accomplished using only a single motor which can be switched to provide rotation in both directions.

Figure 10:
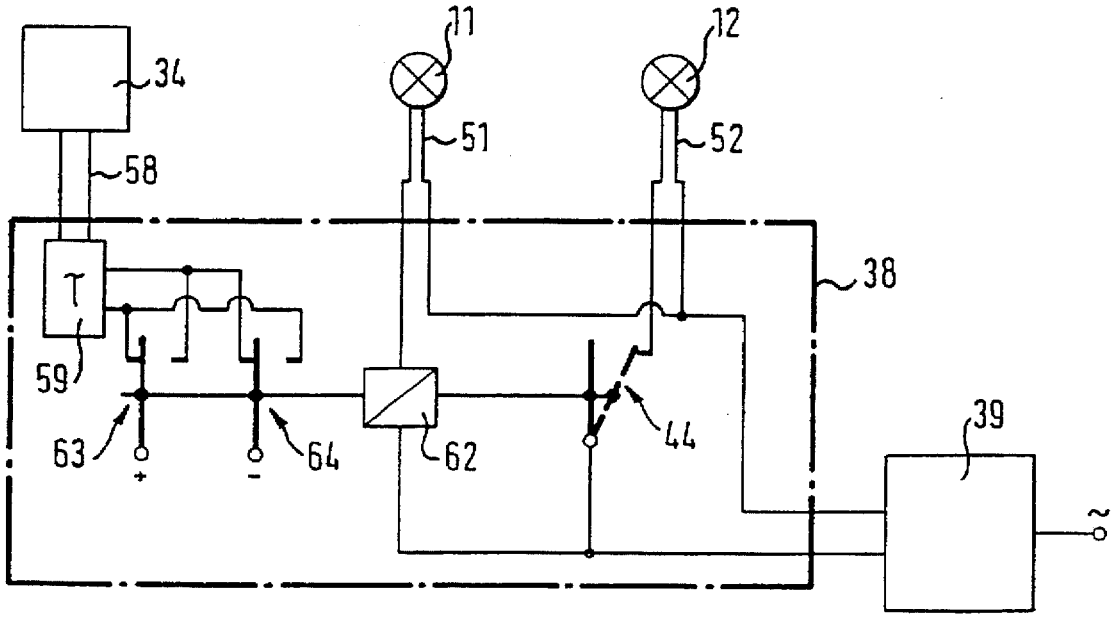

FIG. 10 shows purely schematically a possibility of supplying power to the bulbs 11, 12 and to the geared motor 34 which can be switched to provide rotation in both directions.

A power supply 39 supplies a voltage to the control device 38 suitable for lighting the bulbs 11, 12. The current for the main bulb 11 flows through a relay 62, which closes as a result of this current and holds the switch 44 connected to it in the open position. The replacement bulb 12 is connected to the voltage supplied by the power supply 39 via the change-over switch 44.

When the main bulb 11 burns out, the current flow through the relay 62 ceases and the switch 44 is moved, for example by a spring, into the rest position indicated in dashed lines in FIG. 10, in which position the replacement bulb 12 is now connected to the supply voltage. The replacement bulb 12 is thus automatically switched on when the main bulb 11 burns out.

The relay 62 has, however, two further switch contacts 63, 64, which for example are supplied with a d.c. voltage and, in the switch position shown in FIG. 10, in which current flows through the relay 62, supply a direct current to the motor 34 via a timer circuit 59 and a supply line 58 in such a manner that said motor is driven in that direction of rotation for which the rotatable shaft 27 is rotated in the direction indicated by the dashed arrow in FIG. 9, whereby the pivotal holder 16 is pivoted into the waiting position and the pivotal holder 15 is pivoted into the desired position. The timer circuit 59 is designed in such a manner that it shuts off the motor 34 automatically when the time required by the pivotal holders 15, 16 to arrive at the positions shown in FIG. 9 has elapsed with certainty.

In the other position of the switch contacts 63, 64 the voltage supplied to the motor is reversed in polarity so that the motor 34 rotates in the opposite direction. The timer circuit is started again simultaneously with the switchover of the switch contacts 63, 64, which takes place when the current flow through the relay 62 ceases due to the burnout of the main bulb 11.

Thus if the main bulb 11 burns out, not only is the replacement bulb 12 immediately switched on automatically, but rather the geared motor 34 is also set rotating in such a manner that the rotatable shaft 27 begins to rotate in the direction indicated in FIG. 9 by a solid arrow. The timer circuit 59 ensures in this case as well that the geared motor 34 remains switched on only as long as required to ensure that the pivotal holder 15 has reached the bulb replacement position 21 with certainty and the pivotal holder 16 has reached the desired position, in which the replacement bulb 12 occupies the desired position 13.

A substantial advantage of the present invention is thus that the immediate switchover from the main bulb 11 to the replacement bulb 12 ensures that a short period of darkness does not occur in the operation room when the main bulb 11 burns out. Since the geared motor 34 is also set in motion when the main bulb 11 burns out, it is further ensured that the main bulb 11 is immediately removed from the desired position and the replacement bulb 12 is brought into this position.

It is furthermore important for the design in accordance with the invention that when the main bulb 11 is pivoted out from the desired position, the spring 19 assists the geared motor 34, so that the removal of the main bulb 11 from the desired position proceeds substantially more rapidly than the pivoting in of the replacement bulb 12, during which process the motor 34 must work against the spring 46. The replacement bulb 12 is thus pivoted more slowly, i.e. cautiously, into the desired position; whereas the burned out main bulb 11 can be brought substantially more rapidly into the bulb replacement position 21, which is not a disadvantage, but rather is advantageous, since the main bulb 11 is burned out anyway, and further damage to be expected from the abrupt movement no longer plays a role.

I claim:

1. An operating lamp with at least one main bulb (11) arranged at a desired position (13) and a replacement bulb (12) arranged at a waiting position (14) located next to to the desired position (13), with the main bulb (11) and the replacement bulb (12) being displaceably mounted and controlled in such a way that when the main bulb (11) burns out the main bulb is moved away from the desired position (13) and the replacement bulb (12) is moved from the waiting position to the desired position (13) and is held there, characterized in that the main bulb (11) and the replacement bulb (12) are mounted on a first and second holder (15, 16), which are movable independently of one another, and in that control of movement is such that after the main bulb (11) has burned out only the first holder (15) is first moved until the main bulb has been removed from the desired position (13); and in that the second holder (16) of the replacement bulb (12) is then moved until the replacement bulb (12) is located at the desired position (13).

2. The operating lamp in accordance with claim 1, characterized in that the two pivotal holders (15, 16) which are movable independently of one another are provided and are coaxial to one another and axially displaced relative to one another, with the holders having carrying arms (17, 18) which extend to the main bulb (11) and to the replacement bulb (12) respectively with ends of the arms which carry the main bulb (11) and the replacement bulb (12) respectively, via sockets (30, 31), being so positioned that through pivotal movement both the main bulb (11) and also the replacement bulb (12) can be brought to the desired position (13).

3. The operating lamp in accordance with claim 2, characterized in that the two pivotal holders (15, 16) have rotatable sleeves (23, 24) which are axially displaced and are arranged behind one another in an axial direction, with the rotatable sleeves being arranged on a stationary spigot (25) forming a rotary bearing and/or on a rotatable shaft (27).

4. The operating lamp in accordance with claim 3, characterized in that the rotatable sleeves (23, 24) can be so motorically driven from opposite axial sides that only one of the two rotatable sleeves (23, 24) can rotate at any point in time.

5. The operating lamp in accordance with claim 2, characterized in that the main lamp carrier arm (17) is biased by a spring (19) in an outward pivotal direction, but is first hindered by a motorically movable abutment (20) from movement in the outward pivotal direction; in that the abutment (20) is set in movement after the main bulb (11) has burned out until the main bulb (11) has reached a bulb exchange position (21); and in that the abutment (20) on being moved further first acts at the replacement bulb holder (16), which is originally held by a spring (46) and a second abutment (47) at the waiting position (14), and moves the second abutment against the force of the spring (46) until the replacement bulb (12) is located at the desired position (13).

6. The operating lamp in accordance with claim 5, characterized in that at least one (23) of the two rotatable sleeves is rotatably journalled on a rotary shaft (27) which can be motorically driven to execute a rotary movement and which has the radially projecting abutment (20) which cooperates with counter abutments (28, 29) at the first rotatable sleeve (23) and at the second rotatable sleeve (24) respectively.

7. The operating lamp in accordance with claim 6, characterized in that the counter abutments (28, 29) are formed as sector shaped cut-outs (56, 57) displaced in the circumferential direction in the axially adjacent end-faces of the rotatable sleeves (23, 24); and in that the abutment (20) is arranged radially of the rotatable shaft (27), which extends through the two rotatable sleeves (23, 24), with half of the abutment in each of the two sector shaped cut-outs (56, 57).

8. The operating lamp in accordance with claim 1, characterized in that the bulbs (11, 12), which are arranged behind one another in a peripheral direction, have lamp filaments (40), which extend at least substantially in a straight line and parallel to one another, with a longitudinal axis of the filaments extending a clear angle with the peripheral direction (41).

9. The operating lamp in accordance with claim 8, characterized in that the angle amounts to 30° to 60°.

10. The operating lamp in accordance with claim 8, characterized in that the angle amounts to approximately 45°.

11. The operating lamp in accordance with claim 1, characterized in that the pivotal holders (15, 16) are symmetrically formed relative to that pivotal plane (56) which extends through the centre of the bulb filaments (40) in such a way that a same type of pivotal holder (15, 16) can be used, solely through installation in two positions displaced angularly by 180° relative to the perpendicular to the pivot axis (32) through the centre of the lamp filament (40), to receive both the main bulb (11) and also the replacement-bulb (12).

12. The operating lamp in accordance with claim 2, characterized in that only one motor, the electric motor (34) is provided for the driving of both pivotal holders (15, 16) and is driveable in opposite directions of rotation and can be stopped in the respective end positions of the pivotal holders (15, 16).

13. The operating lamp in accordance with claim 12, characterized in that on burning out of the main bulb (11), the replacement bulb (12) is automatically switched on and the motor (34) is driven in a direction of rotation in which the motor moves the main bulb (11) from the desired position (13) into the bulb exchange position (21) and moves the replacement bulb (12) from the waiting position (14) to the desired position (13).

14. The operating lamp in accordance with claim 12, characterized in that on switching on the intact main bulb (11) in the bulb exchange position (21) the replacement bulb (12) is automatically switched off and the motor (34) is driven in a direction of rotation in which the motor first moves the replacement bulb (12) from the desired position (13) to the waiting position (14) and then moves the main bulb (11 ) from the bulb exchange position (21) to the desired position (13).

15. The operating lamp in accordance with claim 12, characterized in that a time circuit (59) is inserted into the feed line (58) to the motor (34) which in each case only drives the motor, which is switched on or switched over by a relay, for a time such that the pivotal holders (15, 16) reliably reach the provided end positions.

16. A method for automatically replacing a burned out main bulb (11) by a replacement bulb (12) in an operating lamp with at least one main bulb (11) arranged at a desired position (13) and the replacement bulb (12) arranged at a waiting position (14) located next to to the desired position (13), with the main bulb (11) and the replacement bulb (12) being adjustably held and controlled in such a way that on burning out of the main bulb (11) the latter is moved away from the desired position (13) and the replacement bulb (12),is brought from the waiting position (14) to the desired position (13) and firmly held there, the method including the steps of displacing and or pivoting the main bulb (11) first from the desired position (13) to a bulb exchange position (21) while leaving the replacement bulb (12) at the waiting position (14);

displacing and or pivoting the replacement bulb (12) from the waiting position (14) to the desired position (13) wherein the replacement bulb (12) is only set in motion when the main bulb (11) has reached the bulb exchange position (21).

17. The method in accordance with claim 16, characterized by replacing the main bulb (11), which is still located in the bulb exchange position (21), switching on the main bulb, simultaneously switching off the replacement bulb (12) and simultaneously conveying the replacement bulb (12) from the desired position (13) to the waiting position (14);

wherein only when the replacement bulb (12) has reached the waiting position (14) is the main bulb (12) moved from the bulb exchange position (21) to the desired position (13).

18. The method in accordance with claim 16, characterized by replacing;

switching on the main bulb, simultaneously preventing renewed switching on of the replacement bulb (12), and simultaneously conveying the replacement bulb (12) from the desired position (13) to the waiting position (14);

wherein only when the replacement bulb (12) has reached the waiting position (14) is the main bulb (12) moved from the bulb exchange position (21) to the desired position (13).

* * * * *